US012421955B2

(12) United States Patent
Itou et al.

(10) Patent No.: US 12,421,955 B2
(45) Date of Patent: Sep. 23, 2025

(54) AIR COMPRESSOR

(71) Applicant: HITACHI INDUSTRIAL EQUIPMENT SYSTEMS CO., LTD., Tokyo (JP)

(72) Inventors: Yuuji Itou, Tokyo (JP); Toshiaki Yabe, Tokyo (JP); Kohei Sakai, Tokyo (JP); Takashi Nakajima, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 35 days.

(21) Appl. No.: 18/020,290

(22) PCT Filed: Aug. 16, 2021

(86) PCT No.: PCT/JP2021/029874
§ 371 (c)(1),
(2) Date: Feb. 8, 2023

(87) PCT Pub. No.: WO2022/044862
PCT Pub. Date: Mar. 3, 2022

(65) Prior Publication Data

US 2023/0332591 A1 Oct. 19, 2023

(30) Foreign Application Priority Data

Aug. 24, 2020 (JP) ..... 2020-140799

(51) Int. Cl.
*F04B 49/06* (2006.01)
*F04B 35/04* (2006.01)
(Continued)

(52) U.S. Cl.
CPC ..... *F04B 49/06* (2013.01); *F04B 35/04* (2013.01); *F04B 49/08* (2013.01); *F04B 49/20* (2013.01);
(Continued)

(58) Field of Classification Search
CPC ..... F04B 35/04; F04B 49/06; F04B 49/08; F04B 49/20; F04B 49/225; F04B 2207/02
(Continued)

(56) References Cited

U.S. PATENT DOCUMENTS 6,461,112 B1 10/2002 Ohta et al.
8,241,007 B2 * 8/2012 Tanaka ..... F04C 29/126 417/28
(Continued)

FOREIGN PATENT DOCUMENTS

JP 2001-342982 A 12/2001
WO WO-2018179789 A1 * 10/2018 ..... F04B 35/04
WO WO-2020044231 A1 * 3/2020 ..... F04B 49/02

OTHER PUBLICATIONS

International Preliminary Report on Patentability received in corresponding International Application No. PCT/JP2021/029874 dated Mar. 9, 2023.
(Continued)

*Primary Examiner* — Alexander B Comley
(74) *Attorney, Agent, or Firm* — Mattingly & Malur, PC

(57) ABSTRACT

Provided is an air compressor that suppresses a rise in delivery temperature due to a change in atmospheric pressure, and consequently improves the life of parts. The air compressor 1 includes a motor 2, a compressor main body 3 driven by the motor 2 to compress air, a delivery pressure sensor 12 that senses a delivery pressure of the compressor main body 3, an atmospheric pressure sensor 13 that senses an atmospheric pressure, and a controller 15. The controller 15 compares the delivery pressure sensed by the delivery pressure sensor 12 with a set pressure, and performs operation control based on a result of the comparison. The controller 15 corrects the set pressure such that a ratio between the atmospheric pressure sensed by the atmospheric
(Continued)

pressure sensor 13 and the set pressure becomes a set value set in advance.

2 Claims, 2 Drawing Sheets

(51) Int. Cl.
*F04B 49/08* (2006.01)
*F04B 49/20* (2006.01)
*F04B 49/22* (2006.01)

(52) U.S. Cl.
CPC ..... *F04B 49/225* (2013.01); *F04B 2207/02* (2013.01)

(58) Field of Classification Search
USPC ..... 417/22
See application file for complete search history.

(56) References Cited

U.S. PATENT DOCUMENTS

| | | | | |
|---|---|---|---|---|
| 2013/0236331 | A1* | 9/2013 | Hutchinson | F04C 28/08 417/22 |
| 2017/0298926 | A1* | 10/2017 | Kato | F02D 35/026 |
| 2018/0372086 | A1* | 12/2018 | Yashiki | F04B 49/10 |
| 2019/0154024 | A1* | 5/2019 | De Keyser | F04B 49/065 |
| 2020/0011324 | A1 | 1/2020 | Oshiro | |
| 2021/0172436 | A1* | 6/2021 | Daniels | F04B 49/065 |

OTHER PUBLICATIONS

International Search Report of PCT/JP2021/029874 dated Sep. 21, 2021.

* cited by examiner

AIR COMPRESSOR

TECHNICAL FIELD

The present invention relates to an air compressor.

BACKGROUND ART

An air compressor of Patent Document 1 includes a motor, a compressor main body that is driven by the motor to compress air, a delivery pressure sensor that senses a delivery pressure of the compressor main body, and a controller. The controller compares the delivery pressure sensed by the delivery pressure sensor with a set pressure (specifically, a control pressure, an upper limit pressure, and a lower limit pressure to be described later), and performs operation control based on a result of the comparison.

The air compressor of Patent Document 1 further includes an inverter that controls a speed of rotation of the motor. The controller varies the speed of rotation of the motor via the inverter such that the delivery pressure sensed by the delivery pressure sensor becomes the control pressure (for example, 0.69 MPa (gage pressure)).

The air compressor of Patent Document 1 further includes an air discharge valve that can discharge air on a delivery side of the compressor main body. When the delivery pressure sensed by the delivery pressure sensor is equal to or higher than the upper limit pressure (for example, 0.72 MPa (gage pressure)), the controller switches the air discharge valve from a closed state to an opened state to discharge air on the delivery side of the compressor main body. Thus, switching is performed from load operation to no-load operation. When the delivery pressure sensed by the delivery pressure sensor is thereafter equal to or lower than the lower limit pressure (for example, 0.69 MPa (gage pressure)), the controller switches the air discharge valve from the opened state to the closed state. Thus, switching is performed from the no-load operation to the load operation.

PRIOR ART DOCUMENT

Patent Document

Patent Document 1: JP-2001-342982-A

SUMMARY OF THE INVENTION

Problem to be Solved by the Invention

Incidentally, for example, in a case where the air compressor is installed on a highland, or in a case of bad weather, an atmospheric pressure is lower than a standard value (0.101 MPa), and a suction pressure of the compressor main body is decreased. Meanwhile, if the above-described set pressure is unchanged, a variable range of the delivery pressure of the compressor main body remains unchanged. Therefore, a ratio between the suction pressure and the delivery pressure of the compressor main body is increased to cause overcompression, and a delivery temperature rises. As a result, there is a possibility of reducing the life of parts.

The present invention has been made in view of the above-described circumstances. It is one of objects of the present invention to suppress a rise in the delivery temperature due to a change in the atmospheric pressure, and consequently improve the life of parts.

Means for Solving the Problem

In order to solve the above problem, configurations described in claims are applied. The present invention includes a plurality of means for solving the above-described problem. To cite an example thereof, there is provided an air compressor including a motor, a compressor main body that is driven by the motor to compress air, a delivery pressure sensor that senses a delivery pressure of the compressor main body, and a controller configured to compare the delivery pressure sensed by the delivery pressure sensor with a set pressure and perform operation control based on a result of the comparison. The air compressor includes a device that senses or inputs an atmospheric pressure, and the controller corrects the set pressure such that a ratio between the atmospheric pressure sensed or input by the device and the set pressure becomes a set value set in advance.

Advantages of the Invention

According to the present invention, it is possible to suppress a rise in the delivery temperature due to a change in the atmospheric pressure, and consequently improve the life of parts.

Problems, configurations, and advantageous effects other than those described above will be made apparent by the following description.

MODES FOR CARRYING OUT THE INVENTION

Figure 1:
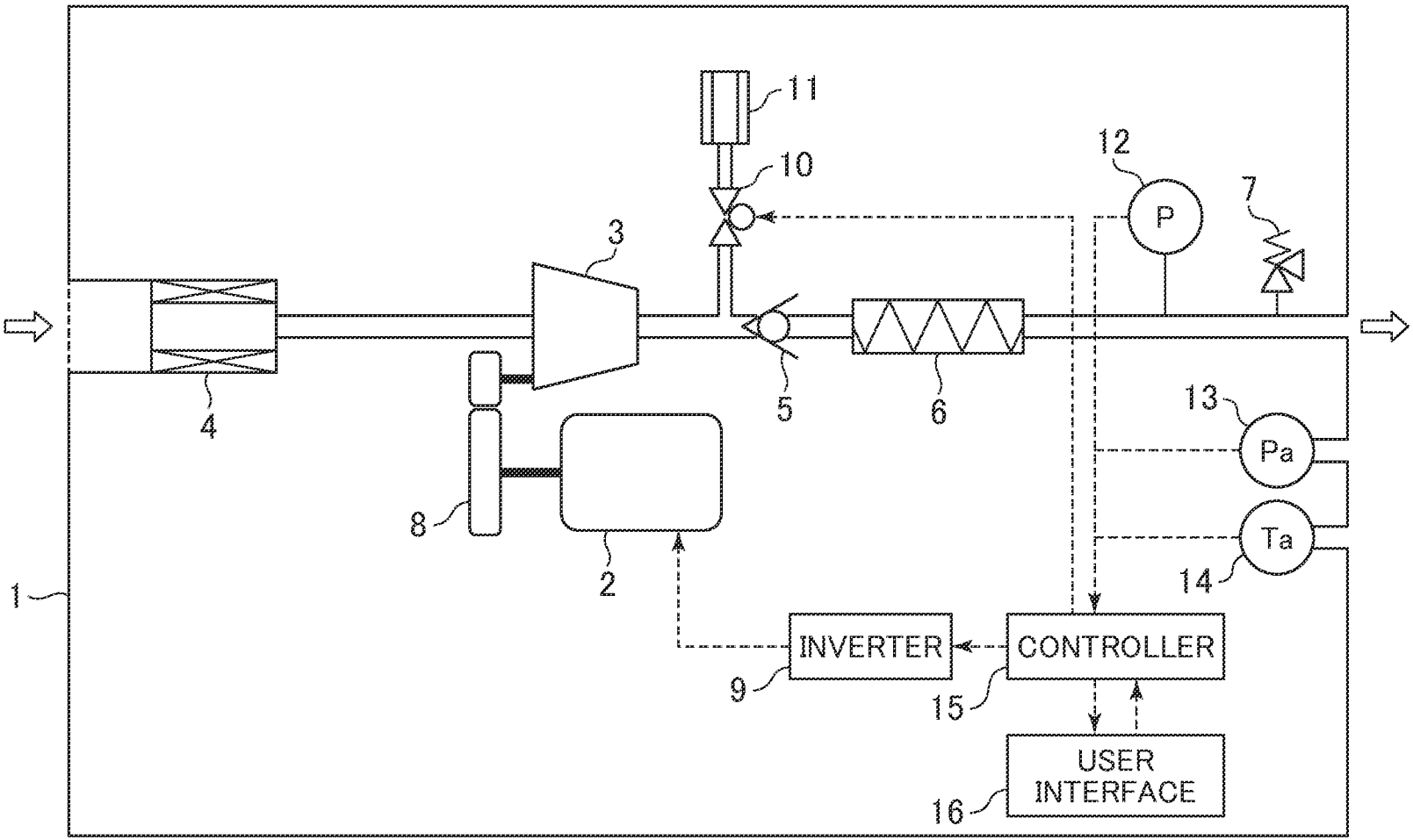
FIG. 1 is a schematic diagram illustrating a configuration of an air compressor in a first embodiment of the present invention.

A first embodiment of the present invention will be described with reference to FIG. 1. FIG. 1 is a schematic diagram illustrating a configuration of an air compressor in the present embodiment.

The air compressor 1 according to the present embodiment includes a motor 2 (driving source), a compressor main body 3 driven by the motor 2 to compress air, an air filter 4 disposed on a suction side of the compressor main body 3, and a check valve 5, a heat exchanger 6, and a relief valve 7 that are disposed on a delivery side of the compressor main body 3. These components are contained in a housing.

Though not illustrated, the compressor main body 3, for example, has a pair of female and male screw rotors meshing with each other and a casing containing the screw rotors therein. A plurality of working chambers are formed in grooves of the screw rotors. A rotational force of the motor 2 is transmitted via a speed increasing gear 8 and the like, so that the screw rotors rotate. Each working chamber moves in an axial direction of the rotors as the rotors rotate, and sequentially performs a suction process of sucking air, a compression process of compressing the air, and a delivery process of delivering the compressed air.

The check valve 5 allows a flow of the compressed air from the compressor main body 3 to the heat exchanger 6 and checks a reverse flow of the compressed air from the heat exchanger 6 to the compressor main body 3. The heat exchanger 6 cools the compressed air from the compressor main body 3 by a heat exchange with a refrigerant such as cooling air or cooling water. The relief valve 7 is actuated to discharge air when the pressure of the compressed air is equal to or higher than a relief pressure (specifically, a pressure higher than an upper limit pressure to be described later). Incidentally, the compressed air cooled by the heat exchanger 6 is supplied to an outside of the housing to be used.

The air compressor 1 according to the present embodiment further includes an inverter 9 that controls a speed of rotation of the motor 2, an air discharge valve 10 (solenoid valve) and an air discharge silencer 11 that are provided on a path branched from a path between the compressor main body 3 and the check valve 5, a delivery pressure sensor 12 disposed on a downstream side of the heat exchanger 6 to sense a delivery pressure of the compressor main body 3, an atmospheric pressure sensor 13 that senses an atmospheric pressure, an atmospheric temperature sensor 14 that senses an atmospheric temperature, a controller 15, and a user interface 16.

Though not illustrated, the controller 15 includes a computation control section (for example, a CPU) that performs computation processing and control processing on the basis of a program, a storage section (for example, a ROM and a RAM) that stores the program and a result of the computation processing, and the like. Though not illustrated, the user interface 16 includes a plurality of operating switches and a monitor.

The controller 15 determines whether or not the atmospheric temperature sensed by the atmospheric temperature sensor 14 is equal to or higher than an upper limit temperature. When the atmospheric temperature is equal to or higher than the upper limit temperature, the controller 15 outputs a warning command to the user interface 16 to cause the user interface 16 to display a warning.

The controller 15 compares the delivery pressure sensed by the delivery pressure sensor 12 with a set pressure (specifically, a control pressure, an upper limit pressure, and a lower limit pressure to be described later) and performs operation control based on a result of the comparison.

The controller 15 variably controls the speed of rotation of the motor 2 via the inverter 9 such that the delivery pressure sensed by the delivery pressure sensor 12 becomes the control pressure. Specifically, the speed of rotation of the motor 2 is decreased when the delivery pressure sensed by the delivery pressure sensor 12 is higher than the control pressure, and the speed of rotation of the motor 2 is increased when the delivery pressure sensed by the delivery pressure sensor 12 is lower than the control pressure. A delivery amount of the compressed air is thus changed according to a change in an amount of usage of the compressed air.

However, when the amount of usage of the compressed air is small, the speed of rotation of the motor 2 reaches a minimum speed of rotation, and the delivery pressure rises above the control pressure. When the delivery pressure sensed by the delivery pressure sensor 12 is equal to or higher than the upper limit pressure (specifically, a pressure higher than the above-described control pressure), the controller 15 switches the air discharge valve 10 from a closed state to an opened state to discharge air on the delivery side of the compressor main body 3. Thus, switching is performed from load operation to no-load operation. When the delivery pressure sensed by the delivery pressure sensor 12 is thereafter equal to or lower than the lower limit pressure (specifically, a pressure lower than the above-described control pressure), the controller switches the air discharge valve 10 from the opened state to the closed state. Thus, switching is performed from the no-load operation to the load operation.

Incidentally, the delivery pressure sensed by the delivery pressure sensor 12 and the set pressure (specifically, the control pressure, the upper limit pressure, and the lower limit pressure described above) may both be absolute pressures or may both be gage pressures. Alternatively, one of the pressure sensed by the delivery pressure sensor 12 and the set pressure may be an absolute pressure, and the other may be a gage pressure. In this case, the controller 15 needs to perform conversion into the absolute pressure or the gage pressure by using the atmospheric pressure sensed by the atmospheric pressure sensor 13.

Incidentally, for example, in a case where the air compressor 1 is installed on a highland, or in a case of bad weather, the atmospheric pressure is lower than a standard value (0.101 MPa), and a suction pressure of the compressor main body 3 is decreased. Meanwhile, if the set pressure (specifically, the control pressure, the upper limit pressure, and the lower limit pressure described above) is unchanged, a variable range of the delivery pressure of the compressor main body 3 remains unchanged. Therefore, a ratio between the suction pressure and the delivery pressure of the compressor main body 3 is increased to cause overcompression, and there is a possibility of a rise in delivery temperature.

Accordingly, as a most significant feature of the present embodiment, the controller 15 corrects the control pressure such that a ratio between the atmospheric pressure Pa sensed by the atmospheric pressure sensor 13 and the control pressure (absolute pressure) Pc becomes a set value set in advance. Specifically, the control pressure (absolute pressure) Pc is computed by using the following Equation (1), or the control pressure (gage pressure) Pc' is computed by using the following Equation (2).

[Math. 1]

$$P_c = P_a \times \left(\frac{P_{co}}{P_{ao}}\right) \tag{1}$$

[Math. 2]

$$P'_c = P_a \times \left(\frac{P_{ao} + P'_{co}}{P_{ao}} - 1\right) \tag{2}$$

"Pao" in Equation (1) is the standard value (0.101 MPa) of the atmospheric pressure. "Pco" is the control pressure (absolute pressure) that is set assuming a case where the atmospheric pressure is the standard value. "Pco/Pao" is a set value. "Pco'" in Equation (2) is the control pressure (gage pressure) that is set assuming the case where the atmospheric pressure is the standard value. "(Pao+Pco')/Pao" is a set value. For example, when Pco=0.801 MPa or Pco'=0.700 MPa is set, Pco/Pao=(Pao+Pco')/Pao=7.93. Then, when Pa=0.090 MPa, for example, Pc=0.714 MPa or Pc'=0.624 MPa.

The controller 15 corrects the upper limit pressure and the lower limit pressure together with the above-described correction of the control pressure. Specifically, the controller corrects the upper limit pressure such that a difference between the upper limit pressure and the control pressure becomes a set value (for example, 0.02 MPa) set in advance. In addition, the controller corrects the lower limit pressure such that a difference between the control pressure and the lower limit pressure becomes a set value (for example, 0.1 MPa) set in advance. For example, when the control pressure (absolute pressure) Pc is 0.714 MPa or the control pressure (gage pressure) Pc' is 0.624 MPa, the upper limit pressure (absolute pressure) Pu is 0.734 MPa or the upper limit pressure (gage pressure) Pu' is 0.644 MPa, and the lower limit pressure (absolute pressure) Pd is 0.614 MPa or the lower limit pressure (gage pressure) Pd' is 0.524 MPa. Incidentally, the lower limit pressure is corrected so as not to be below a minimum pressure set in advance.

As described above, in the present embodiment, the control pressure is corrected such that the ratio between the atmospheric pressure sensed by the atmospheric pressure sensor 13 and the control pressure becomes a set value, and the upper limit pressure and the lower limit pressure are corrected. It is therefore possible to suppress an increase in the ratio between the suction pressure and the delivery pressure of the compressor main body 3 due to a change in the atmospheric pressure, and consequently suppress a rise in the delivery temperature. As a result, the life of parts can be improved.

In addition, the delivery pressure (gage pressure) of the compressor main body 3 can be inhibited from rising above a maximum pressure (specifically, the upper limit pressure in the case where the atmospheric pressure is the standard value). Consequently, when the relief pressure of the relief valve 7 is a gage pressure, for example, the actuation of the relief valve 7 can be suppressed.

It is to be noted that, while, in the first embodiment, description has been made by taking as an example a case where the controller 15 corrects the upper limit pressure such that the difference between the upper limit pressure and the control pressure becomes a set value set in advance, and the controller 15 corrects the lower limit pressure such that the difference between the control pressure and the lower limit pressure becomes a set value set in advance, there is no limitation to this. The controller 15 may correct the upper limit pressure such that a ratio between the atmospheric pressure Pa sensed by the atmospheric pressure sensor 13 and the upper limit pressure (absolute value) Pu becomes a set value set in advance. Specifically, the upper limit pressure (absolute pressure) Pu may be computed by using the following Equation (3), or the upper limit pressure (gage pressure) Pu' may be computed by using the following Equation (4).

[Math. 3]

$$P_u = P_a \times \left(\frac{P_{uo}}{P_{ao}}\right) \tag{3}$$

[Math. 4]

$$P'_u = P_a \times \left(\frac{P_{ao} + P'_{uo}}{P_{ao}} - 1\right) \tag{4}$$

"Puo" in Equation (3) is the upper limit pressure (absolute pressure) that is set assuming the case where the atmospheric pressure is the standard value. "Puo/Pao" is a set value. "Puo'" in Equation (4) is the upper limit pressure (gage pressure) that is set assuming the case where the atmospheric pressure is the standard value. "(Pao+Puo')/Pao" is a set value. For example, when Puo=0.821 MPa or Puo'=0.720 MPa is set, Puo/Pao=(Pao+Puo')/Pao=8.13. Then, when Pa=0.090 MPa, for example, Pu=0.732 MPa or Pu'=0.642 MPa.

In addition, the controller 15 may correct the lower limit pressure such that a ratio between the atmospheric pressure Pa sensed by the atmospheric pressure sensor 13 and the lower limit pressure (absolute value) Pd becomes a set value set in advance. Specifically, the lower limit pressure (absolute pressure) Pd may be computed by using the following Equation (5), or the lower limit pressure (gage pressure) Pd' may be computed by using the following Equation (6).

[Math. 5]

$$P_d = P_a \times \left(\frac{P_{do}}{P_{ao}}\right) \tag{5}$$

[Math. 6]

$$P'_d = P_a \times \left(\frac{P_{ao} + P'_{do}}{P_{ao}} - 1\right) \tag{6}$$

"Pdo" in Equation (5) is the lower limit pressure (absolute pressure) that is set assuming the case where the atmospheric pressure is the standard value. "Pdo/Pao" is a set value. "Pdo'" in Equation (6) is the lower limit pressure (gage pressure) that is set assuming the case where the atmospheric pressure is the standard value. "(Pao+Pdo')/Pao" is a set value. For example, when Pdo=0.701 MPa or Pdo'=0.600 MPa is set, Pdo/Pao=(Pao+Pdo')/Pao=6.94. Then, when Pa=0.090 MPa, for example, Pd=0.625 MPa or Pd'=0.535 MPa.

A first modification described above can also provide advantageous effects similar to those of the first embodiment.

In addition, in the first embodiment and the first modification, description has been made by taking as an example a case where the air compressor 1 includes the atmospheric pressure sensor 13. However, there is no limitation to this. The air compressor 1 may include a device that inputs the atmospheric pressure in place of the atmospheric pressure sensor 13 (specifically, for example, the user interface 16 may have a function of inputting the atmospheric pressure or may be a communicating device that receives information from the outside). The controller 15 may correct the control pressure such that the ratio between the atmospheric pressure input by the above-described device and the control pressure becomes a set value set in advance. In addition, the controller 15 may correct the upper limit pressure such that the ratio between the atmospheric pressure input by the above-described device and the upper limit pressure becomes a set value set in advance, and the controller 15 may correct the lower limit pressure such that the ratio between the atmospheric pressure input by the above-described device and the lower limit pressure becomes a set value set in advance.

In addition, in the first embodiment and the first modification, though not particularly described, the air compressor 1 may include a mode selecting device that selects one of a normal mode and a correction mode (specifically, for example, the user interface 16 may have a function of selecting one of the normal mode and the correction mode). The controller 15 may disable a function of correcting the set pressure (specifically, the control pressure, the upper limit pressure, and the lower limit pressure) when the normal mode is selected in the mode selecting device, and the controller 15 may enable the function of correcting the set pressure when the correction mode is selected in the mode selecting device.

In addition, in the first embodiment and the first modification, description has been made by taking as an example a case where the air compressor 1 includes the air discharge valve 10, and the controller 15 has a function of performing operation control that switches between the load operation and the no-load operation by controlling the air discharge valve 10. However, there is no limitation to this. The air compressor 1 may include a suction throttle valve 17 (see FIG. 2 to be described later) that can close the suction side of the compressor main body 3 in addition to the air discharge valve 10, and the controller 15 may have a function of performing operation control that switches between the load operation and the no-load operation by controlling the air discharge valve 10 and the suction throttle valve 17. In addition, the air compressor 1 may include the suction throttle valve 17 in place of the air discharge valve 10, and the controller 15 may have a function of performing operation control that switches between the load operation and the no-load operation by controlling the suction throttle valve 17.

In addition, the air compressor 1 may include neither of the air discharge valve 10 and the suction throttle valve 17, and the controller 15 may not have the function of performing operation control that switches between the load operation and the no-load operation. In this case, it suffices for the controller 15 to correct only the control pressure as the set pressure.

Figure 2:
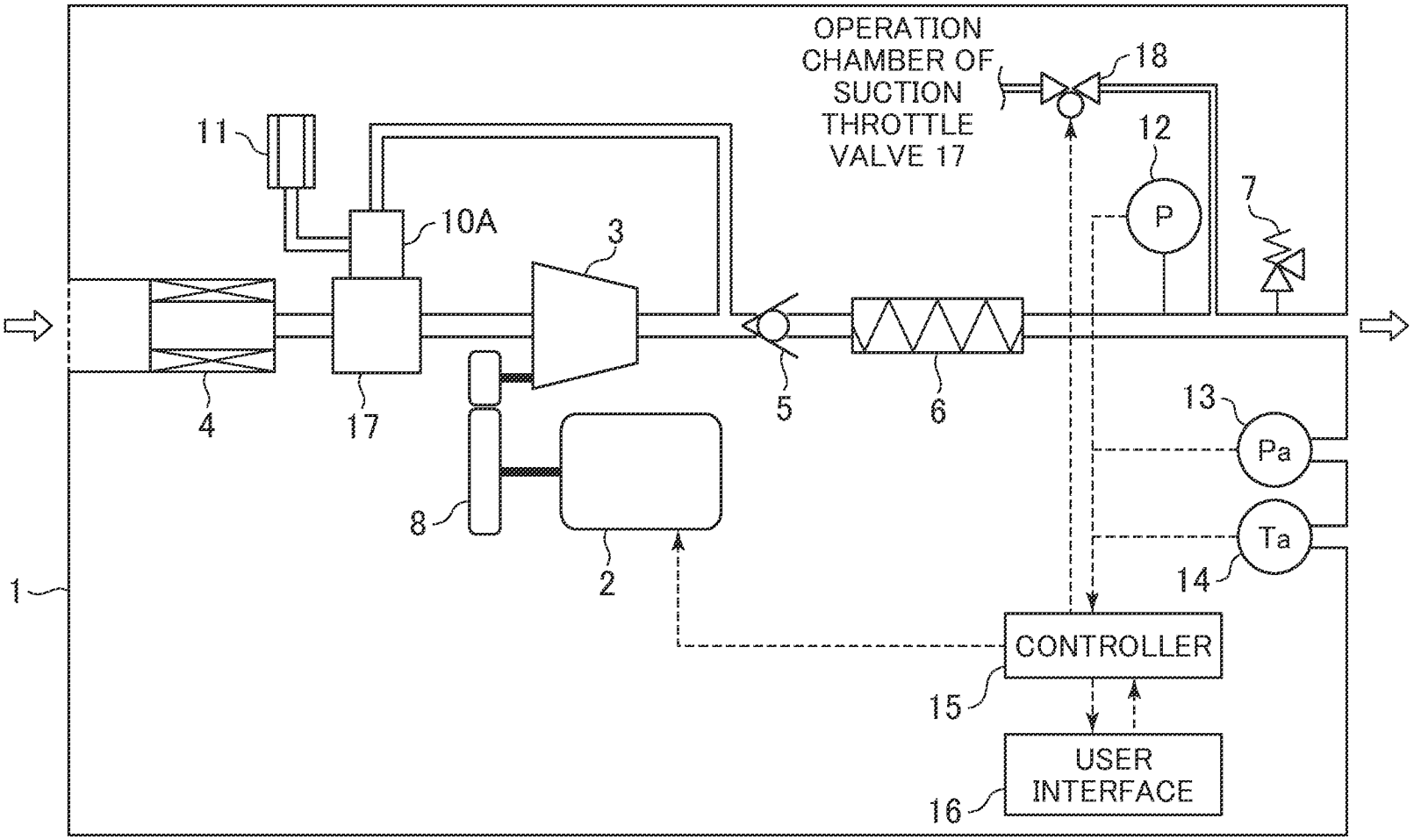
FIG. 2 is a schematic diagram illustrating a configuration of an air compressor in a second embodiment of the present invention.

A second embodiment of the present invention will be described with reference to FIG. 2. FIG. 2 is a schematic diagram illustrating a configuration of an air compressor in the present embodiment. Incidentally, in the present embodiment, parts similar to those of the first embodiment are denoted by the same reference characters, and description thereof will be omitted as appropriate.

The air compressor 1 in the present embodiment does not include the inverter 9, and the controller 15 does not have the function of performing operation control that varies the speed of rotation of the motor 2 via the inverter 9.

The air compressor 1 in the present embodiment includes the suction throttle valve 17 that can close the suction side of the compressor main body 3 and a control valve 18 (solenoid valve) provided to a path branched from a path between the heat exchanger 6 and the relief valve 7. An operation chamber of the suction throttle valve 17 is connected to the path branched from the path between the heat exchanger 6 and the relief valve 7. A valve disc of the suction throttle valve 17 and a valve disc of an air discharge valve 10A are connected to each other and are interlocked with each other. When the control valve 18 is in a closed state, the pressure of the operation chamber of the suction throttle valve 17 drops, and therefore the suction throttle valve 17 is set in an opened state. The air discharge valve 10A is set in a closed state in an interlocked manner. When the control valve 18 is in an opened state, on the other hand, the pressure of the operation chamber of the suction throttle valve 17 rises, and therefore the suction throttle valve 17 is set in a closed state. The air discharge valve 10A is set in an opened state in an interlocked manner.

When the delivery pressure sensed by the delivery pressure sensor 12 is equal to or higher than the upper limit pressure, the controller 15 switches the control valve 18 from the closed state to the opened state, and thus switches from the load operation to the no-load operation. That is, the suction throttle valve 17 is set in the closed state to close the suction side of the compressor main body 3, and the air discharge valve 10A is set in the opened state to discharge air on the delivery side of the compressor main body 3. When the delivery pressure sensed by the delivery pressure sensor 12 is thereafter equal to or lower than the lower limit pressure, the controller switches the control valve 18 from the opened state to the closed state, and thus switches from the no-load operation to the load operation. That is, the suction throttle valve 17 is set in the opened state, and the air discharge valve 10A is set in the closed state.

As a most significant feature of the present embodiment, the controller 15 corrects the upper limit pressure such that the ratio between the atmospheric pressure Pa sensed by the atmospheric pressure sensor 13 and the upper limit pressure (absolute pressure) Pu becomes a set value set in advance. Specifically, the upper limit pressure (absolute pressure) Pu is computed by using the above-described Equation (3), or the upper limit pressure (gage pressure) Pu' is computed by using the above-described Equation (4). For example, when Puo=0.821 MPa or Puo'=0.720 MPa is set, Puo/Pao=(Pao+Puo')/Pao=8.13. Then, when Pa=0.090 MPa, for example, Pu=0.732 MPa or Pu'=0.642 MPa.

The controller 15 corrects the lower limit pressure together with the above-described correction of the upper limit pressure. Specifically, the controller corrects the lower limit pressure such that a difference between the upper limit pressure and the lower limit pressure becomes a set value (for example, 0.12 MPa) set in advance. For example, when the upper limit pressure (absolute pressure) Pu is 0.732 MPa or the upper limit pressure (gage pressure) Pu' is 0.642 MPa, the lower limit pressure (absolute pressure) Pd is 0.612 MPa or the lower limit pressure (gage pressure) Pd' is 0.522 MPa. Incidentally, the lower limit pressure is corrected so as not to be below a minimum pressure set in advance.

As described above, in the present embodiment, the upper limit pressure is corrected such that the ratio between the atmospheric pressure sensed by the atmospheric pressure sensor 13 and the upper limit pressure becomes a set value, and the lower limit pressure is corrected. It is therefore possible to suppress an increase in the ratio between the suction pressure and the delivery pressure of the compressor main body 3 due to a change in the atmospheric pressure, and consequently suppress a rise in the delivery temperature. As a result, the life of parts can be improved. In addition, the actuation of the relief valve 7 can be suppressed.

It is to be noted that, while, in the second embodiment, description has been made by taking as an example a case where the controller 15 corrects the lower limit pressure such that the difference between the upper limit pressure and the lower limit pressure becomes a set value set in advance, there is no limitation to this. The controller 15 may correct the lower limit pressure such that the ratio between the atmospheric pressure Pa sensed by the atmospheric pressure sensor 13 and the lower limit pressure (absolute value) Pd becomes a set value set in advance. Specifically, the lower limit pressure (absolute pressure) Pd may be computed by using the above-described Equation (5), or the lower limit pressure (gage pressure) Pd' may be computed by using the above-described Equation (6). For example, when Pdo=0.701 MPa or Pdo'=0.600 MPa is set, Pdo/Pao=(Pao+Pdo')/Pao=6.94. Then, when Pa=0.090 MPa, for example, Pd=0.625 MPa or Pd'=0.535 MPa. This second modification can also provide advantageous effects similar to those of the second embodiment.

In addition, in the second embodiment and the second modification, description has been made by taking as an example a case where the air compressor 1 includes the atmospheric pressure sensor 13. However, there is no limitation to this. The air compressor 1 may include a device that inputs the atmospheric pressure in place of the atmospheric pressure sensor 13 (specifically, for example, the user interface 16 may have a function of inputting the atmospheric pressure or may be a communicating device that receives information from the outside). The controller 15 may correct the upper limit pressure such that a ratio between the atmospheric pressure input by the above-described device and the upper limit pressure becomes a set value set in advance. In addition, the controller 15 may correct the lower limit pressure such that a ratio between the atmospheric pressure input by the above-described device and the lower limit pressure becomes a set value set in advance.

In addition, in the second embodiment and the second modification, though not particularly described, the air compressor 1 may include a mode selecting device that selects one of a normal mode and a correction mode (specifically, for example, the user interface 16 may have a function of selecting one of the normal mode and the correction mode). The controller 15 may disable a function of correcting the set pressure (specifically, the upper limit pressure and the lower limit pressure) when the normal mode is selected in the mode selecting device, and the controller 15 may enable the function of correcting the set pressure when the correction mode is selected in the mode selecting device.

In addition, in the second embodiment and the second modification, description has been made by taking as an example a case where the air compressor 1 includes the air discharge valve 10A and the suction throttle valve 17, and the controller 15 has a function of performing operation control that switches between the load operation and the no-load operation by controlling the air discharge valve 10A and the suction throttle valve 17. However, there is no limitation to this. The air compressor 1 may include one of the air discharge valve 10A and the suction throttle valve 17, and the controller 15 may have a function of performing operation control that switches between the load operation and the no-load operation by controlling one of the air discharge valve 10 and the suction throttle valve 17.

In addition, in the first and second embodiments and the like, description has been made by taking as an example a case where the air compressor 1 is of a no-liquid-supply type (specifically, a type that compresses air without supplying the working chambers of the compressor main body 3 with liquid). However, there is no limitation to this. The air compressor 1 may be of a liquid supply type (specifically, a type that compresses air while supplying the working chambers of the compressor main body 3 with liquid such as oil or water). That is, the air compressor 1 may include a liquid supply system that supplies the working chambers of the compressor main body 3 with liquid such as oil or water and a gas-liquid separator that separates the compressed air delivered from the compressor main body 3 from the liquid included in the compressed air.

In addition, in the first and second embodiments and the like, description has been made by taking as an example a case where the air compressor 1 includes the compressor main body 3 in a single stage. However, there is no limitation to this. The air compressor 1 may include compressor main bodies in a plurality of stages.

DESCRIPTION OF REFERENCE CHARACTERS

1: Air compressor
2: Motor
3: Compressor main body
4: Air filter
5: Check valve
6: Heat exchanger
7: Relief valve
8: Speed increasing gear
9: Inverter
10, 10A: Air discharge valve
11: Air discharge silencer
12: Delivery pressure sensor
13: Atmospheric pressure sensor
14: Atmospheric temperature sensor
15: Controller
16: User interface
17: Suction throttle valve
18: Control valve

The invention claimed is:

1. An air compressor comprising:

a motor;

an inverter that controls a speed of rotation of the motor;

a compressor main body that is driven by the motor to compress air;

a delivery pressure sensor that senses a delivery pressure of the compressor main body; and a controller configured to perform operation control that varies the speed of rotation of the motor via the inverter such that the delivery pressure sensed by the delivery pressure sensor becomes a control pressure as a set pressure, wherein the air compressor includes a device that senses or inputs an atmospheric pressure, wherein the controller corrects the control pressure such that a ratio between the atmospheric pressure sensed or input by the device and the control pressure becomes a set value set in advance, wherein the air compressor further comprises at least one of a suction of a suction throttle valve capable of closing a suction side of the compressor main body and an air discharge valve capable of discharging air on a delivery side of the compressor main body, and wherein the controller is configured to:

perform the operation control that switches from load operation to no-load operation by controlling at least one of the at least one of the suction throttle valve and the air discharge valve when the delivery pressure sensed by the delivery pressure sensor is equal to or higher than an upper limit pressure, and that switches from the no-load operation to the load operation by controlling at least one of the at least one of the suction throttle valve and the air discharge valve when the delivery pressure sensed by the delivery pressure sensor is equal to or lower than a lower limit pressure, and correct the upper limit pressure such that a ratio between the atmospheric pressure sensed or input by the device and the upper limit pressure becomes a set value set in advance, and correct the lower limit pressure such that a ratio between the atmospheric pressure sensed or input by the device and the lower limit pressure becomes a set value set in advance.

2. The air compressor according to claim 1, further comprising:

a mode selecting device that selects one of a normal mode and a correction mode, wherein the controller is configured to disable a function of correcting the control pressure, the upper limit pressure and the lower limit pressure when the mode selecting device selects the normal mode, and enable the function of correcting the control pressure, the upper limit pressure and the lower limit pressure when the mode selecting device selects the correction mode.

* * * * *